US005338271A

United States Patent [19]

Wang

[11] Patent Number: 5,338,271

[45] Date of Patent: Aug. 16, 1994

[54] EXERCISER DEVICE FOR SIMULATING MOUNTAIN CLIMBING AND RUNNING

[75] Inventor: Leao Wang, Taichung Hsien, Taiwan

[73] Assignee: Greenmaster Industrial Corporation, Taichung Hsien, Taiwan

[21] Appl. No.: 107,174

[22] Filed: Aug. 17, 1993

[51] Int. Cl.[5] ..... A63B 69/18; A63B 21/00

[52] U.S. Cl. ..... 482/52; 482/118; 482/120

[58] Field of Search ..... 482/52, 53, 70, 114, 482/115, 116, 117, 118, 120

[56] References Cited

U.S. PATENT DOCUMENTS 4,659,077 4/1987 Stropkay ..... 482/120
4,709,918 12/1987 Grinblat ..... 482/70
4,728,102 3/1988 Pauls ..... 482/118
5,033,733 7/1991 Findlay ..... 482/52

FOREIGN PATENT DOCUMENTS 1708370 1/1992 U.S.S.R. ..... 482/70

*Primary Examiner*—Stephen R. Crow
*Attorney, Agent, or Firm*—Bacon & Thomas

[57] ABSTRACT

The motions of mountain climbing and running are simulated by an exerciser having a pair of movable treadles which are connected to ropes that extend around plural pulleys and having free ends provided with handles which are gripped by the user and pulled during movement of the treadles to thereby exercise both the arms and legs. The treadles are connected to hydraulic cylinders which permit the treadles to be utilized independently of the ropes.

5 Claims, 4 Drawing Sheets

EXERCISER DEVICE FOR SIMULATING MOUNTAIN CLIMBING AND RUNNING

BACKGROUND OF THE INVENTION

The present invention relates to an exerciser for simulating mountain climbing and running, and more particularly to an exerciser equipped with plural pulleys, driving ropes and handles for the user to swing correspondingly when he treads on a pair of treadles, thus imitating the actual movements of mountain climbing and running.

The exerciser of the present invention provides a simple and convenient method of exercise to maintain bodily health, and also train the muscles, and improve stamina and physical agility.

As the need for functions of mechanical products increase, indoor exercisers are being designed to fit a certain sport and become the exclusive trainer of that sport, such as skiing trainer, rowing training and climbing trainer. The exerciser of the present invention is designed to simulate climbing and running and train the four limbs of the human body without concern about the weather. However, skiing, rowing and climbing are unique sports and require sports techniques and coordination of the four limbs. For example, skiing is mostly done by both hands, rowing is done by swinging arc circles repeatedly by both hands and bending the waist in the same rhythm, and climbing has to be done by all four limbs. Obviously, any one trainer has its own unique exercise method to train different parts of the human body.

SUMMARY OF THE INVENTION

The exerciser of the present invention is designed based on the technique of climbing and running on stairs or a mountain. When the user uses this exerciser, his feet will be lifted higher, like striding, while both hands will spring in great breadth from the upper front of the chest to the back of the hips. It is therefore the main object of the present invention to provide a perfect exerciser to train the coordination of four limbs, muscle, stamina, and physical agility through the simulation of climbing and running.

DETAILED DESCRIPTION OF THE PREFERRED EMBODIMENT

Figure 1:
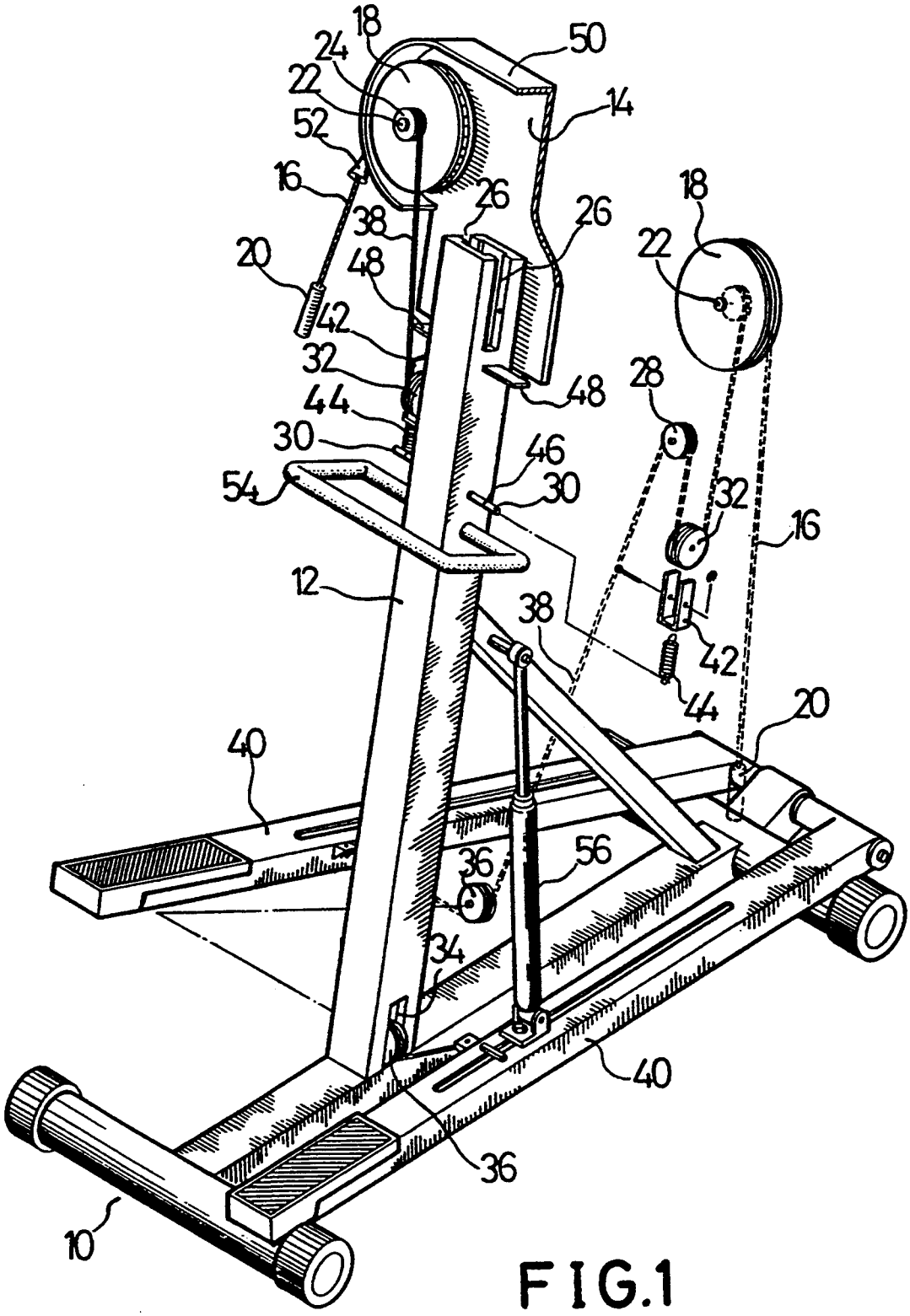
FIG. 1 is an exploded, perspective view of part of the structure of the present invention.
Figure 2:
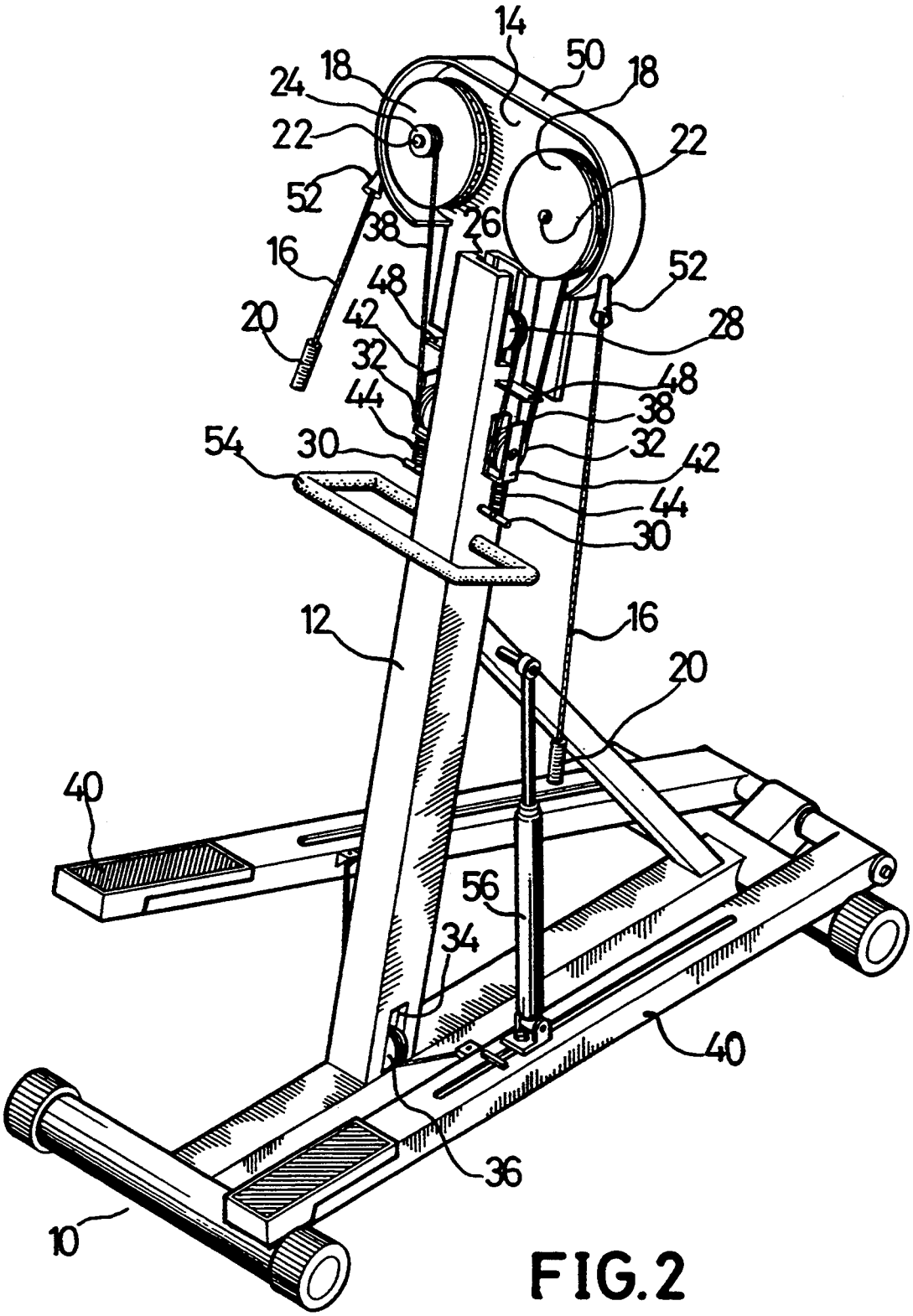
FIG. 2 is an assembly view of the present invention.
Figure 3:
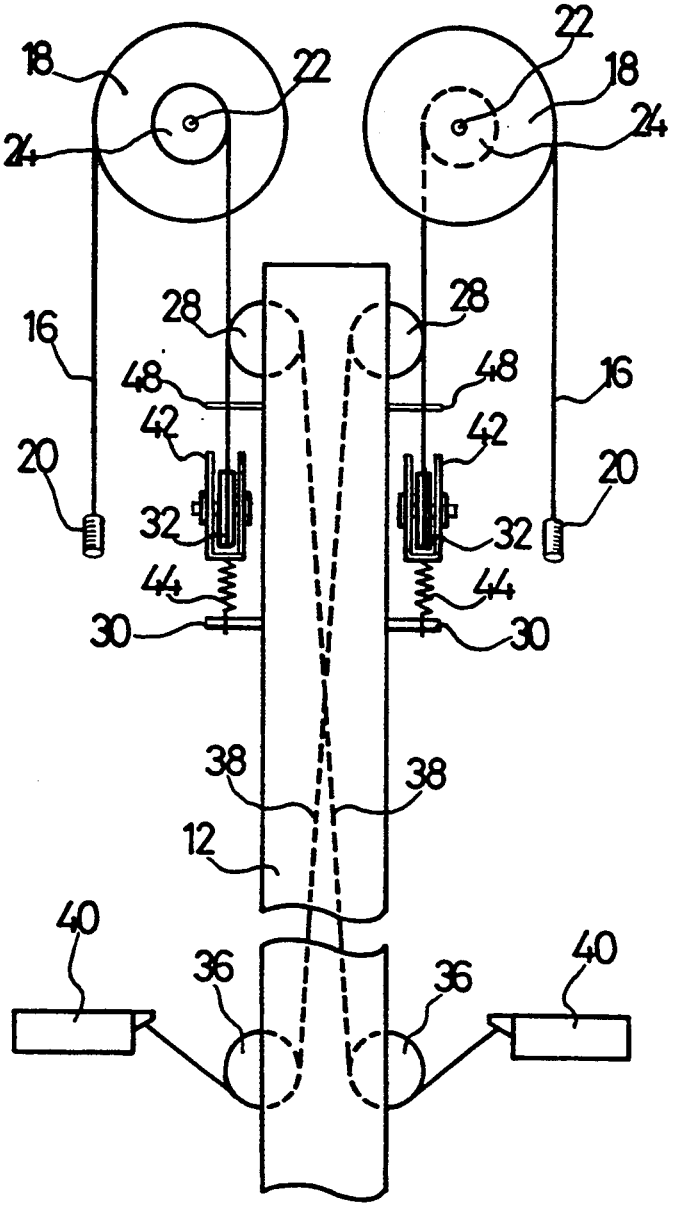
FIG. 3 is a line-up view of the structural units of the front of the present invention.

Referring to FIGS. 1, 2 and 3, the main supporting stem 12 of the main body 10 has a positioning plate 14 installed at the top. Each of two sides of said positioning plate 14 has a manual rotating pulley 18 of large diameter with a driving rope 16, together with a handle 20 which can be pulled by the user for exercise. Moreover, the opposite end of each said manual rotating pulley 18 has a smaller auxiliary pulley 24 on the same axle 22. An open slot 26 is cut on the top of said main supporting stem 12 for locating two positioning pulleys 28, below which two positioning horizontal struts 30 are installed for connecting two moving pulleys 32. The bottom of said supporting stem 12 has a slim slot 34 for installing two rope guiding pulleys 36. Each of two guiding ropes 38 has one end fixed in said auxiliary pulley 24 and extends around said moving pulley 32 and positioning pulley 28, in that order, crosses the hollow inside of said supporting stem 12 to said rope guiding pulley 36 and has its other end fixed in the middle side of a treadle 40. When the user treads on said treadles 40, the manual rotating pulleys 18 rotate correspondingly so that the user can train his arms through pulling said handles 20.

Since said driving ropes 16 on said manual pulley 18 are guided outward, and said guiding ropes 38 on said auxiliary pulleys 24 are guided inward, therefore when one of said manual rotating pulleys 18 rotates in the direction for rope releasing, the treadle 40 moves downward. The other manual rotating pulley 18 will rotate in the direction for rope collecting, and thus the treadle 40 moves upward. Moreover, when one manual rotating pulley 18 rotates in the direction for rope releasing, its corresponding auxiliary pulley 24 will rotate in the direction for rope collecting, while the other auxiliary pulley 24 will rotate in the direction for rope releasing.

Said two moving pulleys 32 are each installed in a U-shaped block 42, the lower end of which is connected to one end of a spring 44, and the other end of spring 44 is fixed in a hook hole 46 of said positioning horizontal strut 30. In the normal state, the rebound of said spring 44 will pull said moving pulley 32 downward for collecting the rope. In other words, when said two guiding ropes 38 are pulled, said springs 44 will stretch for releasing the ropes 38 to let said ropes 38 be stretched taut for positioning said U-shaped blocks 42.

Since each said U-shaped block 42 and moving pulley 32 will be pulled up-and-down by said spring 44 or outer force, a retaining piece 48 is therefore installed above each pulley 32 for limiting the range of pull.

The length of each said ropes 16 and 38 is controlled precisely, together with the function of said springs 44. In the normal state, said two treadles 40 will be at the same height.

To prevent friction between the ropes 16 and cover 50, open rope guides 52 are provided in the shape of trumpets.

Figure 4:
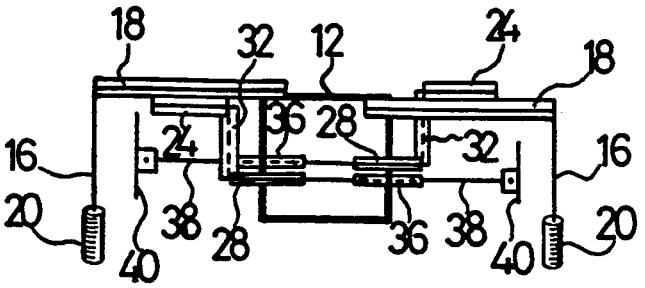
FIG. 4 is a line-up view of plural pulleys at the top of the present invention.

Referring to FIG. 4, said auxiliary pulleys 24 are each installed on an opposite end of each of said two rotating pulleys 18. Said two positioning pulleys 28 are each not in the same tangent line for producing an offset position difference between said auxiliary pulley 24 and guiding rope 38, thus preventing friction when they cross each other in the hollow interior of said supporting stem 12. Therefore, after said driving rope 38 has been pulled from said auxiliary pulley 24, said driving rope will go around said moving pulley from the front and the back and be guided to corresponding positioning pulley 28.

Figure 5:
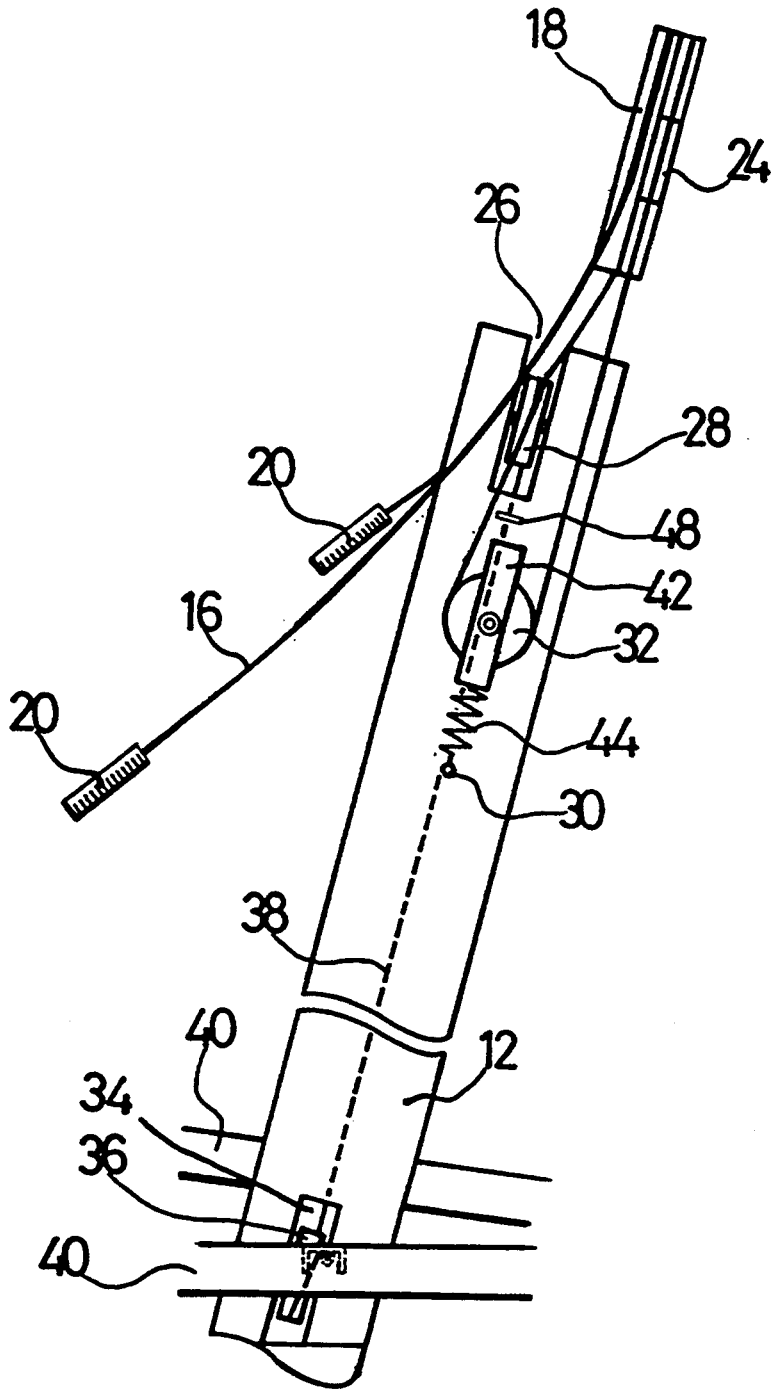
FIG. 5 is a side elevational view of the present invention, including an illustration of its operation.

Referring to FIG. 5, when said treadles 40 are moved up-and-down, the working distance of the human arm will be from the upper front chest to the back of the hip. Therefore, the difference in diameter between said manual pulley 18 and said auxiliary pulley 24 can be varied to establish the stretching range of said corresponding ropes 16 and 38. Of course, the user can chose to tread on said treadles 40 without pulling said rope 16 through handles 20, and merely place hands on a hand rail 54. The two treadles 40 are connected with two spring hydraulic oil cylinder assemblies 56 in the back so that they can rebound automatically. Therefore, said driving ropes 38 will not influence the motion of said treadles 40.

While only a preferred embodiment of the present invention has been shown and described, it will be understood that various modifications and changes can be made without departing from the spirit and scope of the invention.

I claim:

1. An exerciser for simulating climbing and running comprising:

a) a main body;

b) a supporting stem carried by the main body and including an interior space, a top portion provided with a first slot therein and a bottom portion provided with a second slot therein;

c) a positioning plate mounted to the top portion of the supporting stem;

d) a rotating pulley at each of two opposite sides of the positioning plate;

e) a driving rope around each rotating pulley, with each driving rope including a handle at an end thereof;

f) an auxiliary pulley coaxially mounted with each rotating pulley, each auxiliary pulley being of smaller diameter than each rotating pulley;

g) a pair of positioning pulleys located at the first slot of the supporting stem;

h) a pair of horizontal struts extending outwardly from the supporting stem and a moving pulley connected to each horizontal strut;

i) a pair of guiding pulleys located within the second slot;

j) a pair of guiding ropes, each guiding rope having a first end secured to an auxiliary pulley and extending firstly around a moving pulley and secondly around a positioning pulley, the guiding ropes crossing within the interior space of the support stem, each guiding rope extending around a guiding pulley and outwardly of the supporting stem; and k) a pair of treadles movably secured to the main body and each guiding rope including a second end secured to a treadle so that when a user moves the treadles, the rotating pulleys rotate correspondingly when the user pulls the handles.

2. The exerciser of claim 1 wherein each driving rope around each rotating pulley is guided outwardly by the rotating pulley and each guiding rope on each auxiliary pulley is guided inwardly by the auxiliary pulley.

3. The exerciser of claim 1 further including a pair of U-shaped blocks and a pair of springs, each moving pulley being installed within a U-shaped block and a spring connecting the U-shaped block to the horizontal strut.

4. The exerciser of claim 1 wherein the two positioning pulleys are not disposed in the same tangent line for producing an offset position difference between each auxiliary pulley and each guiding rope.

5. The exerciser of claim 1 further including a pair of spring hydraulic oil cylinder assemblies connected to the treadles for automatically rebounding the treadles during movement of the treadles by the user.

* * * * *